United States Patent [19]

Quaas

[11] Patent Number: 4,805,221

[45] Date of Patent: Feb. 14, 1989

[54] CONSTRUCTION OF SOUND CONVERTER IN SOUND GUIDE, ESPECIALLY FOR LOUDSPEAKERS, FOR EXAMPLE SPEAKER BOXES

[76] Inventor: Jurgen Quaas, P.O. Box 2413, Abu Dhabi, United Arab Emirates

[21] Appl. No.: 723,825

[22] Filed: Apr. 16, 1985

[30] Foreign Application Priority Data

Apr. 17, 1984 [DE] Fed. Rep. of Germany ..... 3414407

[51] Int. Cl.[4] ..... H04R 1/28; H04R 1/02

[52] U.S. Cl. ..... 318/90; 181/166; 181/171; 181/172; 381/71; 381/154; 381/157; 381/161; 381/158; 381/188; 381/205

[58] Field of Search ..... 381/90, 87, 88, 89, 381/95, 96, 71, 154, 159, 158, 161, 162, 182, 188, 205; 179/146 R, 146 E; 181/171, 172, 166

[56] References Cited

U.S. PATENT DOCUMENTS

| | | | |
|---|---|---|---|
| 2,041,777 | 5/1926 | Olney et al. | 181/166 |
| 2,072,035 | 12/1937 | Hayenga et al. | 181/166 |
| 2,108,846 | 2/1938 | Brown | 381/90 |
| 2,835,735 | 5/1958 | Moen | 381/71 |
| 3,064,086 | 11/1962 | Sedley | 381/90 |
| 3,393,764 | 7/1968 | Schafer | 381/159 |
| 3,781,475 | 12/1973 | Sharp | 381/188 |
| 3,909,531 | 9/1975 | Plummer | 381/90 |
| 4,176,249 | 11/1979 | Inanaga et al. | 381/199 |
| 4,268,719 | 5/1981 | Manger | 381/89 |
| 4,379,951 | 4/1983 | Gabr | 381/188 |
| 4,420,061 | 12/1983 | Levy | 181/166 |
| 4,451,711 | 5/1984 | Jackson | 381/90 |

FOREIGN PATENT DOCUMENTS

| | | | |
|---|---|---|---|
| 0036230 | 9/1981 | European Pat. Off. | 381/96 |
| 1527032 | 5/1968 | France | 381/90 |
| 2241942 | 3/1975 | France | 381/96 |
| 2380704 | 10/1978 | France | 381/90 |
| 52-45324 | 4/1977 | Japan | 181/166 |
| 0659066 | 10/1951 | United Kingdom | 381/96 |

OTHER PUBLICATIONS

D. DeGreef, "Acceleration Feedback Loudspeaker", *Wireless World,* vol. 87, No. 1548, Sep. 1981.

*Primary Examiner*—Jin F. Ng
*Assistant Examiner*—Danita R. Byrd
*Attorney, Agent, or Firm*—Staas & Halsey

[57] ABSTRACT

An installation of sound converters (e.g., speakers) in an enclosure having mechanical fasteners such that the transmission of solid-borne sound from the speakers to the enclosure is prevented.

12 Claims, 8 Drawing Sheets

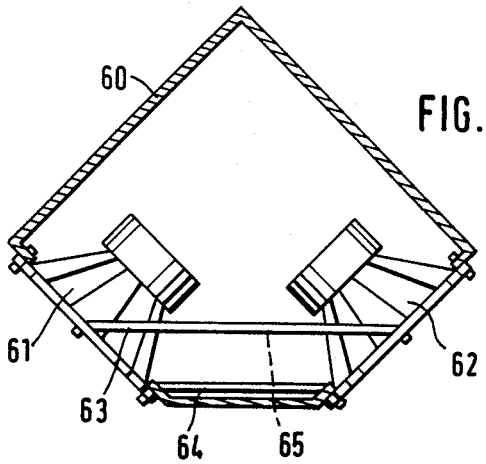
FIG.6
FIG. 7a
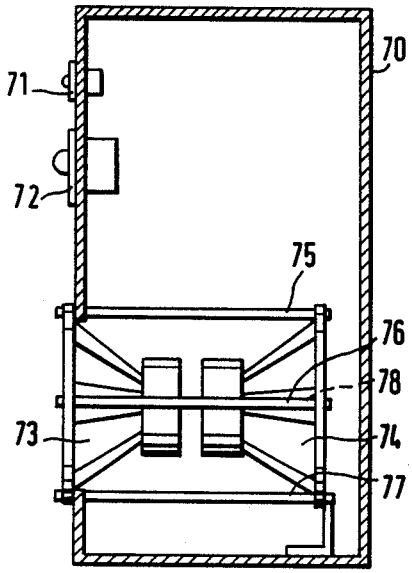
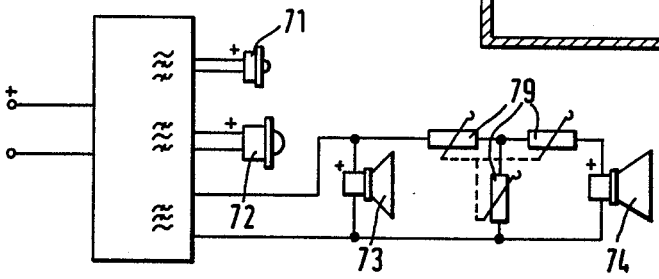
FIG. 7b

CONSTRUCTION OF SOUND CONVERTER IN SOUND GUIDE, ESPECIALLY FOR LOUDSPEAKERS, FOR EXAMPLE SPEAKER BOXES

BACKGROUND OF THE INVENTION

The invention relates to the installation of sound converters in a sound guide, in particular for speakers, preferably for speaker boxes, and is characterized in that the transmission of solid-borne sound from the sound converters to the sound guide is prevented.

The invention pertains in particular to speaker boxes for the highquality transmission of music, such as those which are conventional in professional use and in consumer electronics.

The object of the invention is to improve the quality of reproduction of speaker boxes by eliminating interfering vibrations in the sound guide and housing.

As is known, the purpose of speaker boxes is to convert electrical signals into acoustic ones according to given quality criteria. One of these criteria is the degree of distortion which arises during transmission. To achieve minimum distortion, the sound guide and housing of a speaker box must not themselves function as sources of sound, i.e., they must not be subject to excitation to resonance by vibrations generated by the sound converter.

The concept "sound guide" as used here and hereafter will be understood very generally to mean a device to match the sound converter acoustically to the environment at wavelengths longer than that of its diaphragm. Examples of this are: sound panel, trumpet, closed box, etc. There is no housing with the sound panel, while sound guide and housing are one and the same in the closed box.

The conventional technology for attaining this object consists in providing the sound guide and housing with sufficiently thick walls, adding braces and reinforcements, and/or selecting a material which has high internal damping. Examples of this are speaker boxes made of concrete, marble, ceramic, plexiglass, and aluminum. Multi-layered housings on the sandwich principle, whose inner layer is a highly damping material, such as, for example, sand, are also known.

A disadvantage of all these designs is that the amount of material and labor required is relatively high, engendering correspondingly high costs, and ultimately resulting in heavy, awkward speaker boxes. These advantages of the invention increase with the size of the speaker box and/or the required amount of distortion-free sound reproduction. On the other hand, if the sound guide is not rigid enough, or if the sound converter is connected to the sound guide via an attenuating material, a worsening of pulse behavior and efficiency result.

SUMMARY OF THE INVENTION

Here is where the invention provides a remedy. In particular, one object of the invention has become the discovery of a universally applicable speaker box design principle which will exclude distortions caused by vibration of the housing and sound guide regardless of the type of sound converter and sound guide, and which can be produced with a minimum expenditure for sound guide and housing.

The invention assumes that the solid-borne sound in sound converters excites the sound guide and housing to resonate to a significantly greater extent than does airborne sound, and attains the proposed object by means of dynamic counterforces compensating for the dynamic forces exerted by the one or more sound converter chassis on the sound guide at the point of installation. This prevents the transmission of solid-borne sound from the sound converter or sound converters to the sound guide and housing, and achieves, as a result, the desired reduction in expenditure for sound guide and housing.

The technology of the invention is accomplished by positioning two sound converters in such a way that the direction of motion of their diaphrams keypoints (centers of gravity) lie in the same line. The geometry of positioning is accomplished by mechanically connecting the sound converter chassis together, which connection is made of a material with minimal elasticity. Electrically, the sound converters are wired in such a way that the motion of their diaphragms is 180 degrees out of phase. Two alternatives are available for accomplishing the acoustic circuitry, therefore:

(I) One sound converter is built into in the sound guide and radiates sound waves, while the second only compensates for the chassis vibrations of the first and itself radiates no sound waves farther into the environment.

(II) Both sound converters are built into the sound guide and are acoustically arranged in parallel.

The first alternative suggests itself when existing speaker boxes are to be retrofitted to eliminate solid-borne noise, or if the previous speaker box concept is to be retained. In a further embodiment of the invention, the compensating sound converter can be simplified and modified in such a way that it has a specified movable mass in place of the diaphragm and forms an acoustically, electrically, and mechanically integrated unit with the first, radiating sound converter. This results in a new type of sound converter, entirely free of solid-borne sound, which can be used in the conventional manner for designing speaker boxes. In active speaker boxes, both sound converters can be advantageously tuned to each other simply and precisely by electronic means, perhaps by measurement or simulating the frequency response characteristics of the radiating sound converter, and, if necessary, of the compensating sound converter.

The second alternative would be selected if the configuration of the speaker box were not predetermined, or if high efficiency were valued, since in this case no energy is lost in a separate compensating sound converter. It is preferable that sound converters of the same type, tuned to each other as a pair, be used. This arrangement is not limited to a single pair of sound converters, however; rather, any number of tuned sound converter pairs can be arranged in point-symmetrical configuration, with applications, for example, in omnidirectional speaker boxes or in the drivers of horn speakers.

In a further embodiment of the invention, the sound converters are not connected to the sound guide in the conventional manner, i.e., on their mounting rings; rather, the entire unit consisting of connected sound converters is affixed to the housing or the sound guide, without touching the sound guide, such that vibrations are neutralized are not transmitted from the speaker to the speaker box. This can be done by suspending the arrangement so that it can swing (e.g., FIG. 1*b*), or by fastening it to the housing at its points of installation (e.g., FIG. 1*a*). The gap between the sound converters and sound guide can be used as part of the required hole for bass reflex boxes, or else it is simple to fill with an elastic damping material. This arrangement enjoys the advantage of completely preventing the transmission of solid-borne sound to the sound guide even in the event of incomplete compensation caused perhaps by inequalities in the sound converters or an unequal acoustic load and because of vibrations which are present to a greater or lesser degree due to a certain residual elasticity in the mechanical connection between the sound converters.

Furthermore, the mechanical connection between the sound converters can advantageously be adjustable in order to facilitate adaptation to the shape of the sound guide.

The advantages gained by the invention are:

- Better acoustic properties for speaker boxes due to the absence of interfering sound guide and housing vibrations because of better pulse behavior and a higher degree of efficiency.
- Elimination of interference arising from the transmission of solid-borne noise from a vibrating speaker housing through floors and walls to objects and adjacent spaces which could resonate.
- Reduction in the amount of material used for the sound guide and housing.
- Reduction in the weight of the speaker box.
- Avoidance of materials which are expensive and require extensive processing.
- Feasibility of designing lightweight sound guide and housing structures.
- Better cost/effectiveness ratio for the speaker box.
- Acoustic upgrading of existing speaker boxes through retrofitting of an additional compensating sound converter according to the invention that is, by adding an additional speaker to the rear of an existing speaker (FIGS. 7*a* and 8).
- A universally applicable principle, independent of the type of sound converter and sound guide selected.

DESCRIPTION OF THE PREFERRED EMBODIMENTS

The following explains the invention in greater detail by means of drawings which illustrate its various embodiments.

FIG. 1*a* shows a partial longitudinal section of a three-channel speaker box which applies the principle of reciprocal compensation on the low-range sound converter;

FIG. 1*b* shows the subject of FIG. 1*a*, additionally presenting an option for complete insulation against solid-borne sound from the sound converter;

FIG. 2 *a,b* show two embodiments for the mechanical connection of the sound converters with each other;

FIG. 3 *a,b* show a partial cross section in perspective of an omnidirectional speaker box in which the principle of reciprocal compensation is applied in three wide-band sound converters;

FIG. 6 shows a partial cross section of a speaker box with partial reciprocal compensation of solid-borne sound converter sound;

FIG. 7*a* shows a partial longitudinal section of a speaker box with a sound converter which serves exclusively for compensation;

FIG. 7*b* shows the simplest form of electrical circuitry for FIG. 7*a;*

Figure 8:
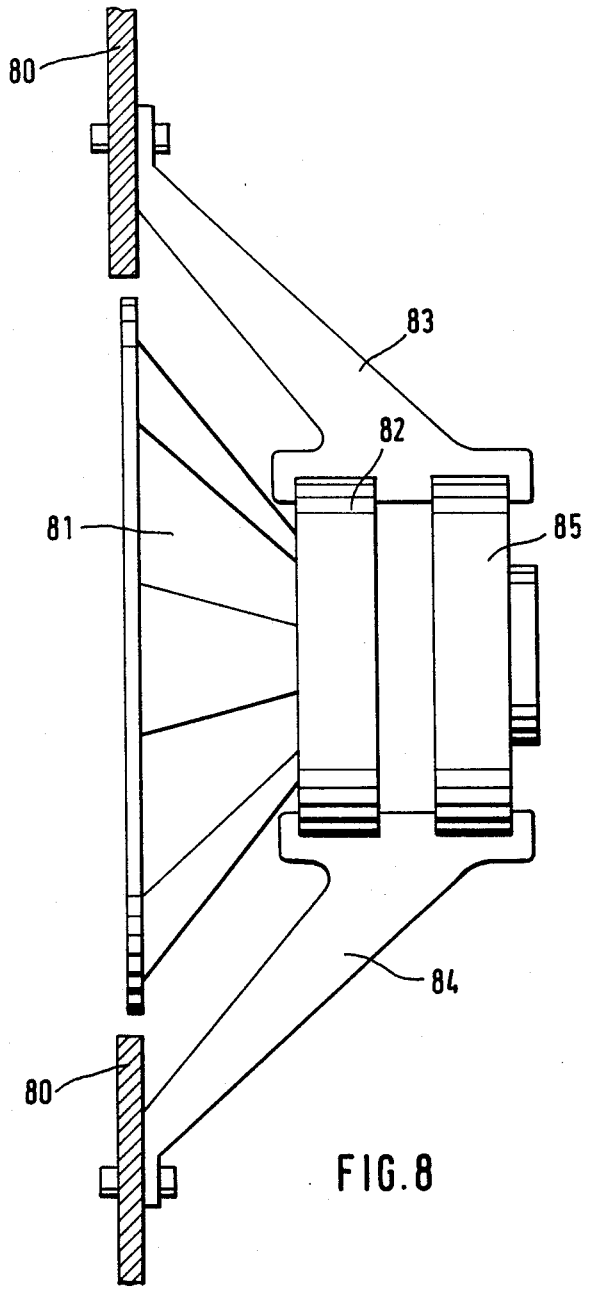
Figure 9A:
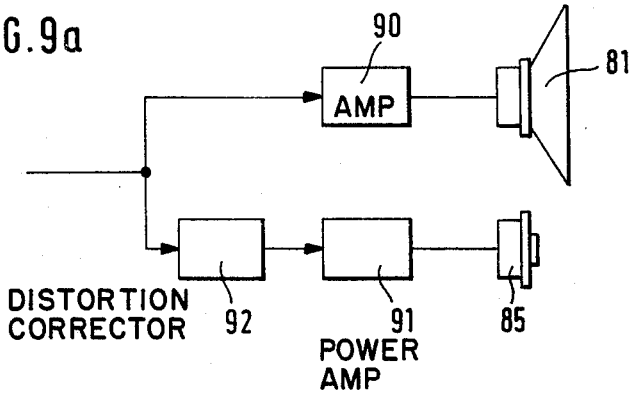
Figure 9B:
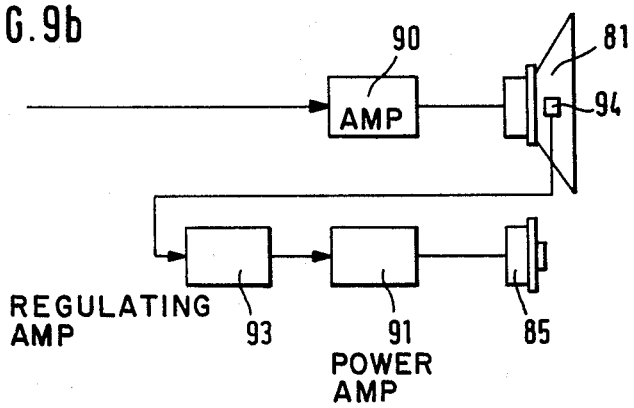
Figure 9C:
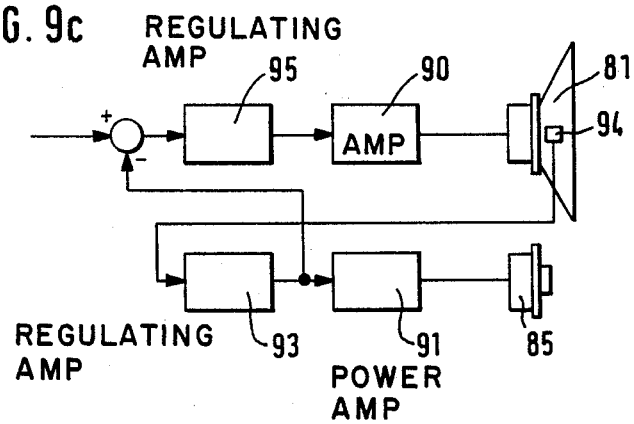

FIG. 8 shows the sound converters in the object in FIG. 7*a* in modified form;

FIG. 9 *a–c* show a block circuit diagram of the electronics to the embodiments in FIG. 7*a* and FIG. 8.

Figure 1A:
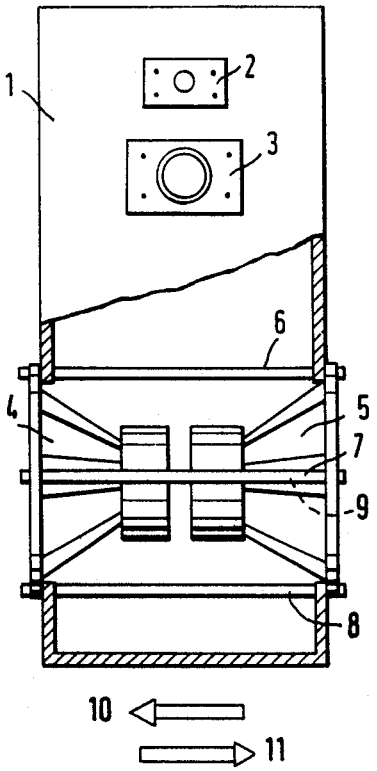

A typical embodiment of the invention, using the example of a closed three-channel speaker box, probably the most commonly-encountered type, is presented in FIG. 1*a*. A sound guide 1, which here is identical to the housing, contains, in addition to sound converters 2, 3 for high-range and low-range reproduction, two identical low-range sound converters 4, 5, which are rigidly connected with each other via mechanical fasteners 6, 7, 8, and 9 (9 is hidden behind 7). The low-range sound converters 4, 5 are parallel connected in phase with each other, electrically and acoustically. If an electrical signal of positive sign or gradient is applied, the diaphragm of sound converter 4 moves in direction 10, and the diaphragm of sound converter 5 in direction 11. According to the physical law of action and reaction, each force also acts with the same intensity in the opposite direction. The force which drives the diaphragm of sound converter 4 in direction 10 also operates as a reaction force in direction 11 on sound converter 1 through magnets and chassis, and through connections 6, 7, 8, and 9 on the other sound converter 5. The same holds true in mirror image for sound converter 5, whose reaction force is exerted in direction 10 through magnets and chassis on sound converter 1, and through connections 6, 7, 8, and 9 on the other sound converter 4. When the input signal has a negative sign or changes sign, the same relationships is obtained, but with reversed signs that is the direction 11 in FIG. 1*a* becomes the positive direction and direction 10 becomes the reaction direction. In each case, the reaction forces from sound converters 4, 5 are exerted in opposing directions. These forces can interact with each other through connections 6, 7, 8, and 9. If they are of equal and opposite magnitude, the sum of the forces is zero, and the sound guide 1 remains unaffected by these forces.

Figure 1B:
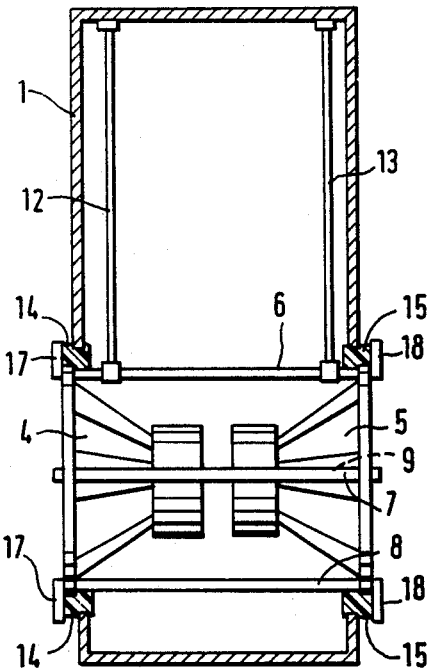

FIG. 1*b* shows the same arrangement as FIG. 1*a*, but here the entire assembly, consisting of sound converters 4, 5 and connections 6, 7, 8, 9, is attached to the sound guide 1 by suspensions 12, 13. Between the sound guide 1 and each of the sound converters 4, 5 there is a ring-shaped gap sealed with elastic damping gaskets 14, 15. Inserts 17, 18 limit violent motion in the unit while the speaker box is being transported. In contrast to the arrangement in FIG. 1*a*, the transmission of vibrations from the chassis of sound converters 4, 5 is even prevented when compensation of the forces is not entirely zero. This the the case, for example, when connections 6, 7, 8, and 9 exhibit elastic properties and thus transmit the forces exerted on them. In the same way, discrepancies between the specifications of sound converters 4 and 5 and unequal acoustic load result in asymmetrical forces. The resulting forces excite the arrangement consisting of sound converters 4, 5, connections 6, 7, 8, and 9, and suspensions 12 and 13, which acts as a physical pendulum, so that it vibrates. If the characteristic frequency of the pendulum lies far below the transmission range of sound converters 4 and 5, the pendulum can no longer follow the exciting vibrations, and becomes practically still. The characteristic frequency of the pendulum is determined exclusively by the effective length of the pendulum and even at relatively short lengths lies far below the usual transmission range of low-range sound converters. The gaskets 14, 15 are not necessary for normal operation, but limit motion more gently than the inserts 17, 18. It is up to the designer's discretion whether the sound guide 1 is also sealed with the gaskets 14, 15 or not. Depending on that, the result is a "closed box" type of sound converter or a "bass reflex box" type of sound converter, respectively.

Figure 2A:
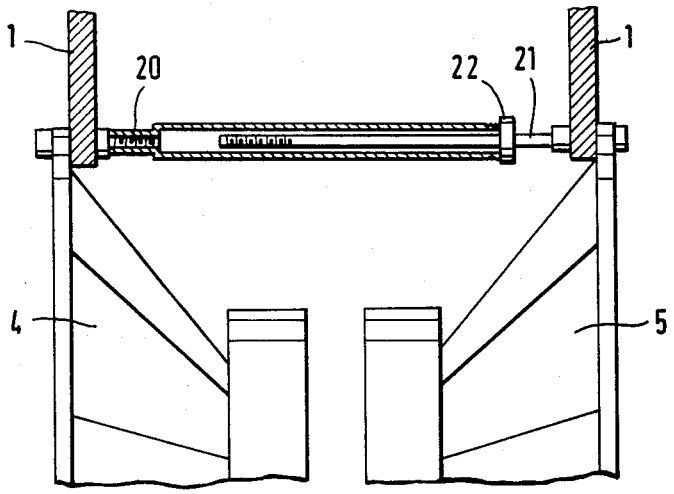

FIG. 2*a* shows an example of the many possible embodiments of the mechanical connection between sound converters 4, 5. Only one of the multiple (usually quadruple) connecting elements present is shown. The embodiment here is one whose length is adjustable. A tightly fitting rod 21 is inserted into a tube 20. A retaining ring 22 fixes the rod 21 and tube 20 together. The free ends of the rod 21 and tube 20 are advisably threaded, which enables the sound converters 4, 5 and sound guide 1 to be connected with screws. The retaining ring 22 contains two different female threads, each of which fits onto the male threads of the tube 20 and the rod 21. Finally, the simplest embodiment consists in dispensing with the tube 20, while making the rod 21 a continuous threaded rod which is cut to the required length in each case.

Figure 2B:
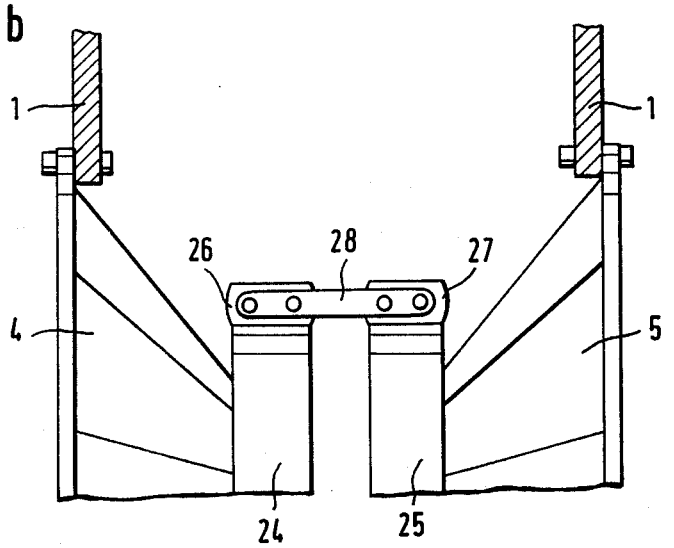

FIG. 2*b* shows another example for embodying the mechanical connection between the sound converters 4, 5. Here, too, only one of the several connections present is displayed. The magnets 24, 25 of the sound converters 4, 5 are provided with fishplates 26, 27, to which a connecting piece 28 is attached by screws. This embodiment is distinctive for its minimal length, which decreases the effects of the elastic properties of the material.

Figure 3A:
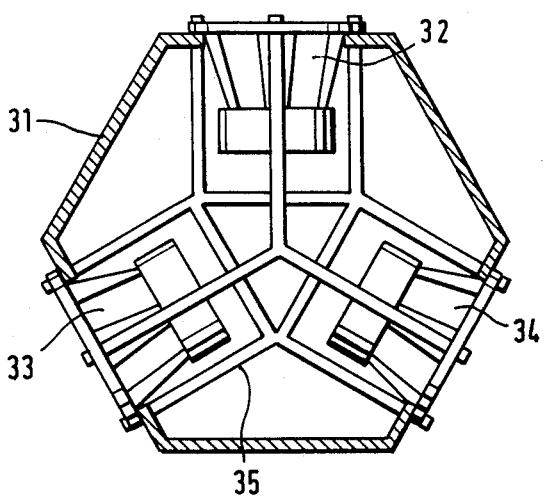
Figure 3B:
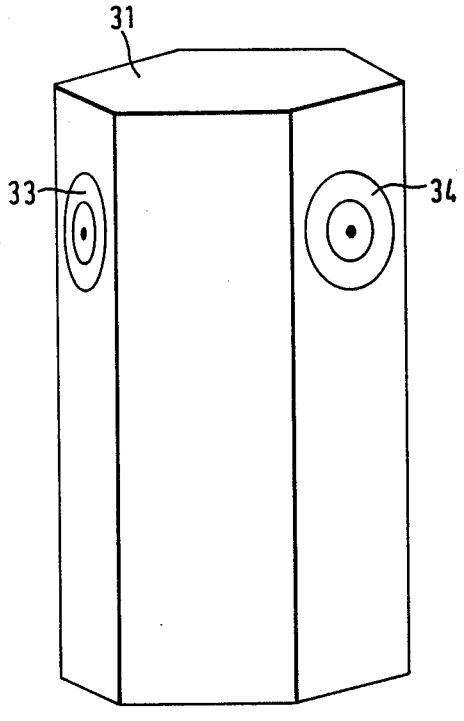

Using the example of an omni-directional hexagonal speaker box 31, presented in partial cross section and in perspective, FIG. 3 shows the arrangement of three sound converters 32, 33, 34 with their mutual mechanical connection 35. The dynamic forces exerted by sound converters 32, 33, 34 on the sound guide 31 are compensated to zero by the point symmetry of the arrangement, given identical specifications for the sound converters. The operating principle presented for the mirror-image arrangement of the sound converters in FIG. 1*a* also holds true, mutatis mutandis, for a point-symmetrical arrangement of more than two sound converters. The mechanical connection 35 here is somewhat more elaborate, since connecting rods lying outside the mid-plane of each of the sound converters must be connected together in order to be able to absorb lateral forces.

Figure 4:
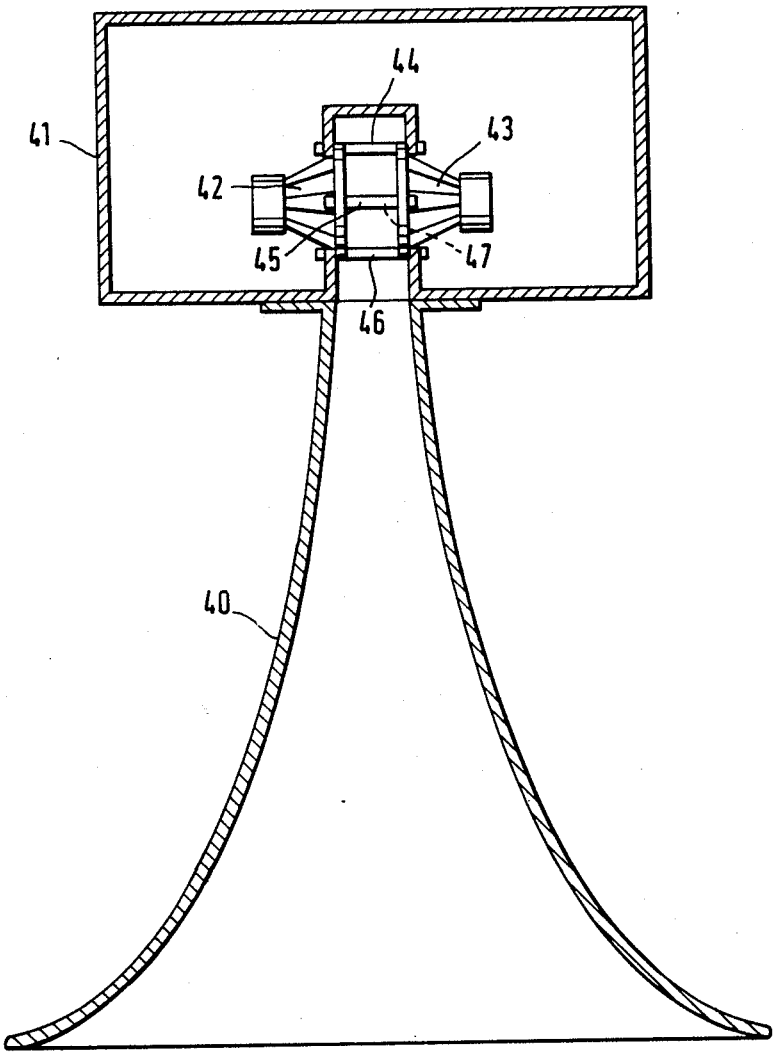
FIG. 4 shows a partial cross section of a horn speaker box in which the principle of reciprocal compensation is applied in the horn driver sound converter.

FIG. 4 shows a partial cross section of a horn speaker box. Sound converters 42, 43, which are connected to each other through mechanical connections 44, 45, 46, 47 (47 concealed behind 45) and the backs of which are sealed off by a sound guide 41, operate as drivers for the horn sound guide 40. More than two sound converters can be combined together in this arrangement as well.

Figure 5:
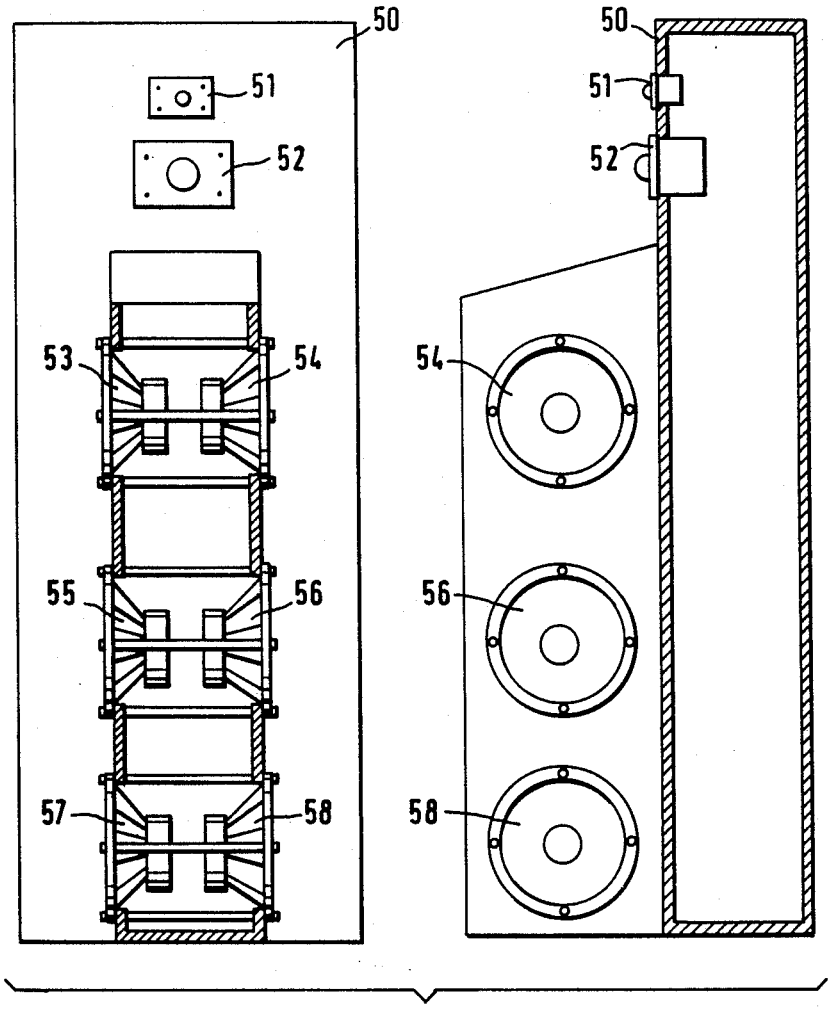
FIG. 5 shows a partial longitudinal front and side view of the subject of FIG. 1*a*, but with several low-range sound converter pairs.

FIG. 5 shows a partial longitudinal section of a three-channel speaker box viewed from the front and the side. Analogously to FIG. 1*a*, a sound guide 50 contains a high-range sound converter 51, a mid-range sound converter 52, and, instead of one pair of large low-range sound converters, three pairs of smaller low-range sound converters 53, 54, 55, 56, 57, and 58. This arrangement enables the low-range sound converters to radiate forward better, which is by nature difficult to achieve through lateral installation at higher frequencies, and which can only be improved by smaller diaphragm diameters. Forward radiation is obtained when the diaphragm is smaller than the smallest wavelength to be radiated.

FIG. 6 shows a partial cross section of a pentagonal speaker box. Sound converters 61, 62 are installed in a sound guide 60 and are connected together through mechanical connections 63, 64, 65 (65 concealed behind 63). Because of the geometry of the sound guide 60, the sound converters 61, 62 are inclined toward each other at an angle. As a result, the reciprocal compensation of forces is not zero; a residual component remains. The example is designed to show, however, that it is logical to connect the sound converters together mechanically, even in speaker boxed in which the sound converters are not exactly parallel to each other, because this achieves at least a reduction in the forces on the sound guide. The effectiveness of this provision depends on the angle between the sound converters.

FIG. 7*a* shows a partial cross section of a three-channel speaker box. A sound guide 70 executed in the form of a closed box contains, in addition to high-range and mid-range sound converters 71, 72, a low-range sound converter 73, which is connected to a low-range sound converter 74 by means of mechanical connections 75, 76, 77, 78 (78 concealed behind 76). In contrast to the preceding examples, sound converter 73 is mounted in front and radiates acoustically, while sound converter 74 is mounted in the interior of sound guide 70 and radiates no sound to the outside. It serves only to compensate for the solid-borne sound from sound converter 73. This embodiment is especially suited for retro-fitting in existing speaker boxes. It is furthermore distinctive in that conventional speaker box designs, with their typical appearance, can be retained. On the other hand, it is necessary to take account of the fact that, in contrast to the previous examples, overall efficiency is lower, which plays a role primarily in passive speaker boxes.

FIG. 7*b* shows the principle behind the electrical circuitry of the speaker box in 7*a* as a passive box. The input signal is applied through a frequency divider to individual sound converters 71, 72, 73, and through a potentiometer 79 in the form of a T-attenuator to converter 74. This potentiometer 79 is used to balance for the best possible compensation. Its execution as a T-attenuator provides for constant impedance over the entire adjustment range and thus avoids feedback into the frequency divider. Examples of circuitry for active speaker boxes follow in FIGS. 9*a–c*.

FIG. 8 shows a semi cross section of an improved embodiment of the arrangement shown in FIG. 7*a*. A sound converter 81 is connected with a special compensating converter 85 by supports 83, 84 which simultaneously serve to attach it to a sound guide 80. Although the arrangement in FIG. 7*a* uses a sound converter for compensation, this need not be a sound converter in the conventional sense, since it is not supposed to radiate any sound. It is possible to dispense with the diaphragm and the frame. It is enough to have the drive system (here: magnet, vibration coil, spider) along with a definite movable mass, e.g., in the form of a ring-shaped weight on the vibration coil. This produces a special compensation converter 85, which requires far less material than a normal sound converter. It is advantageous to connect the compensation converter 85 and the actual sound converter 81 to form an integrated unit which bypasses the problems of mutual mechanical and dynamic matching. There is furthermore an advantage in connecting the entire unit to the sound guide 80 by means of fasteners 83, 84. For one thing, this is a vibration-neutral suspension; for another, the chassis of sound converter 81 can be made more inexpensively.

FIGS. *9a–c* show the block wiring diagrams of various circuitry options for an active speaker box according to FIG. 8 or FIG. *7a*. The input signal in each circuit comes out of the frequency divider wired to sound converter 81.

In FIG. *9a*, this signal is applied through a power amplifier 90 to sound converter 81 and, parallel to it, through a distortion correcter 92 to a second power amplifier 91 and to the compensation converter 85. The advantage of this circuit over above simple parallel wiring of converters 81 and 85 is that differences in the frequency response characteristics of converters 81 and 85 can be equalized by the distortion correcter 92. This correction is usually easier to accomplish and balance in active circuitry than in a passive circuit, as, for example, in FIG. *7b*. Since converter 85 does not radiate sound, a simpler and cheaper version suffices for power amplifier 91 than for amplifier 90.

In FIG. *9b*, the input signal is applied again through amplifier 90 to sound converter 81. Through a measurement amplifier 93, a measurement device 94 delivers signal corresponding to the diaphragm amplitude of sound converter 81. This signal is applied through power amplifier 91 to compensation converter 85. If required, the measurement amplifier can contain a distortion correcter which will correct inequalities in the frequency response characteristics of converter 85. Differing types for converter 81 and different types of sound guides, changes in acoustic load, etc., are automatically taken into account.

FIG. *9c* shows a circuit for regulated active speaker boxes. The input signal passes through a reference junction to a regulating amplifier 95, is amplified in power amplifier 90 and applied to sound converter 81. The latter's diaphragm amplitude is in turn directly or indirectly sensed by a measuring device 94 and a measurement amplifier 93 and, passing through the reference junction, closes the regulating loop for sound converter 81. At the same time, the signal coming from the measurement amplifier 93 is amplified by the power amplifier 91 and applied to converter 85. It is further possible to construct a similar regulating loop for converter 85 in order to regulate inequalities in its frequency response characteristics and specifications.

In very general terms, the following should also be indicated:

The exemplified embodiments explain the invention fundamentally for dynamic sound converters in the low-frequency range. This is because, for one thing, dynamic sound converters are most often used in the low-frequency range. For another thing, the problem of solid-borne sound from a speaker box occurs primarily at low frequncies. The effective forces are at their strongest here, while the internal damping of the sound guide and housing material is usually at its weakest. However, the principle of the invention is neither limited to a specific frequency range nor tied to a specific type of sound converter. In particular, it is logical, in multichannel speaker boxes, to apply the invention to higher-frequency sound converters as well.

The effectiveness of the invention depends to a great extent on the mechanical connection among the sound converters. Connecting points must have no play, and materials with good elastic properties audio frequency range (operating frequency) should not to be used. When designing, it should furthermore be kept in mind that a certain minimum distance must be maintained between the drive systems, i.e., magnets or electrodes, in order to preclude unfavorable mutual interactions.

I claim:

1. A sound converter system comprising:

a sound guide;

sound converter means, mounted within said sound guide, for generating sound and dynamic forces; and mechanical connection means for connecting said sound converter means to said sound guide, for guiding some of the dynamic forces and for mechanically compensating for the guided dynamic forces by providing equal and opposite dynamic counterforces such that the transmission of solid-borne sound from the sound converter means to the sound guide is prevented.

2. A sound converter system according to claim 1 wherein the sound converter means includes sound converters that are mechanically, electrically, and acoustically connected with each other such that the dynamic forces exerted on said mechanical connector means by said converters compensate for each other.

3. A sound converter system according to claim 2, wherein the mechanical connection means is not a component of the sound guide or the speaker box housing.

4. A sound converter system according to claim 2 wherein the mechanical connection means has an adjustable length.

5. A sound converter system according to claim 2, wherein the mechanical connection means exhibits negligible elasticity at operating frequencies.

6. A sound converter system according to claim 2 wherein the sound converter means and the mechanical connection means form a separate unit in which the sound converter means and the mechanical connection means are matched to one another mechanically, electrically, and acoustically.

7. A sound converter system according to claim 2, wherein one of the sound converter means serves solely as a compensating sound converter means to compensate for the solid-borne sound of another one of the sound converter means serving as a radiating sound converter, and does not itself radiate any sound.

8. A sound converter system according to claim 7, wherein the compensating sound converter means comprises a movable mass, and a magnet coil for moving the movable mass.

9. A sound converter system according to claim 7, further comprising:

a distortion-correcting circuit means for correcting differences between the frequency response characteristics of the radiating and compensating sound means.

10. A sound converter system according to claim 7 further comprising:

measuring means for measuring movement of the radiating sound converter means and providing a signal responsive to the movement; and amplifier means for driving the compensating sound converter means in accordance with the signal provided by the measuring means.

11. A sound converter system according to claim 7, further comprising:

regulating circuit means for regulating the movement of the compensating sound converter means.

12. A sound converter system according to claim 10, wherein radiating and compensating sound converter means, the measuring means and the amplifier means are integrated into a single unit which comprises a sound converter means that emits no solid-borne sound.

* * * * *

UNITED STATES PATENT AND TRADEMARK OFFICE

CERTIFICATE OF CORRECTION

PATENT NO. : 4,805,221

DATED : February 14, 1989

INVENTOR(S) : Jürgen Quaas

It is certified that error appears in the above-identified patent and that said Letters Patent is hereby corrected as shown below:

ON TITLE PAGE: [76], "Jürgen Quaas, P.O. Box 2413, Abu Dhabi, United Arab Emirates" should be --Jürgen Quaas, Dipl.-Ing., Panoramastr. 15, 6912 Dielheim/Heidelberg, Federal Republic of Germany--.

Signed and Sealed this

Twenty-fifth Day of February, 1992

*Attest:*

HARRY F. MANBECK, JR.

*Attesting Officer*

*Commissioner of Patents and Trademarks*